United States Patent [19]

Peirish et al.

[11] Patent Number: 4,872,286

[45] Date of Patent: Oct. 10, 1989

[54] EXTERNAL LATCH STRUCTURE FOR LOCKING A DOOR IN DIFFERENT POSITIONS

[75] Inventors: Alfred J. Peirish, McMinnville; Theodore E. Schmidt, Carlton; William C. Thomas, Beaverton, all of Oreg.

[73] Assignee: Pacific Security Systems of America, Inc., Portland, Oreg.

[21] Appl. No.: 196,249

[22] Filed: May 20, 1988

[51] Int. Cl.[4] ..... E05D 13/04

[52] U.S. Cl. ..... 49/449; 292/6; 292/183; 292/201

[58] Field of Search ..... 49/449, 450, 18; 292/139, 183, 201, 5, 6, 7

[56] References Cited

U.S. PATENT DOCUMENTS

| | | | |
|---|---|---|---|
| 2,095,695 | 10/1937 | Greegor . | |
| 2,989,304 | 6/1961 | Ulmann . | |
| 3,426,478 | 2/1969 | Sturges et al. | 49/18 |
| 3,426,829 | 2/1969 | McDaniel et al. . | |
| 3,564,772 | 2/1971 | Ozier et al. | 49/18 |
| 4,368,770 | 1/1983 | Ulfhielm . | |
| 4,723,373 | 2/1988 | Jump | 49/18 |

FOREIGN PATENT DOCUMENTS

| | | | |
|---|---|---|---|
| 0524460 | 12/1953 | Belgium | 292/201 |
| 0929627 | 6/1963 | United Kingdom | 49/18 |

*Primary Examiner*—Kenneth J. Dorner
*Assistant Examiner*—Gerald A. Anderson
*Attorney, Agent, or Firm*—Kolisch, Hartwell & Dickinson

[57] ABSTRACT

Locking mechanism for locking and unlocking a sliding-type door. The mechanism for the most part is mounted externally of the door, and includes a pivoted, frame-mounted locking member pivotable between locking and unlocking positions. A dead latch latches the locking member in its locking position. An air cylinder is actuated, first to release the dead latch, and then to shift the locking member to its unlocking position. A door-carried locking member also is provided for locking the door at a region remote from the region locked by the frame-mounted locking member.

8 Claims, 2 Drawing Sheets

EXTERNAL LATCH STRUCTURE FOR LOCKING A DOOR IN DIFFERENT POSITIONS

BACKGROUND AND SUMMARY OF THE INVENTION

This invention relates to lock mechanism for a door and, more particularly, to such a mechanism which is, for the most part, mounted externally of the door and which is actuatable on command to lock and release the door. The invention has particular utility in the context of a security lock mechanism, such as might be used in detention facilities and industrial applications.

In a detention facility, not infrequently a sliding door is provided for closing a door opening. With such a facility, it is advantageous that the door be securely locked when in its closing position, that the door also be lockable in its open position, that the door have an intermediate, partially open position where it is also capable of being locked, and that a dead latch system be incorporated in the lock mechanism inhibiting tampering with the door closed and locked in this position. The lock mechanism of the invention addresses all of these requirements, by providing that a door controlled thereby be locked at two different zones or regions with the door closed, a dead latch preventing without release of the lock mechanism, and a system which permits a door controlled thereby to be locked in a closed position, a partially open position, or in a fully open position. The lock mechanism is controlled by a power-operated means which enables the door tender to control the condition of the lock mechanism through remote controls. In a specific and preferred embodiment of the invention, such power-operated means takes the form of a fluid-operated ram and, more particularly, an air cylinder, which is readily controlled through valves and switches.

A general object of the invention, therefore, is to provide a new and improved lock mechanism mounted for the most part externally of a door which is adjustable to produce locking and unlocking of the door.

A related object is to provide such a lock mechanism which includes a dead latch inhibiting tampering to produce undesired release.

A further object is to provide such a lock mechanism which includes two locking instrumentalities functioning to lock the door in position when the door is closed.

Another object is to provide such a lock mechanism having the capability of locking the door closed, as well as in an open position and, if desired, in an intermediate position where the door is only partially open.

A further object of the invention is to provide such a lock mechanism where desired adjustments are the result of shifting one instrumentality through operation of a power-operated means, such as an air cylinder.

BRIEF DESCRIPTION OF THE DRAWINGS

These and other objects and advantages are attained by the invention, which will be described hereinbelow in conjunction with the accompany drawings, wherein.

DETAILED DESCRIPTION OF A PREFERRED EMBODIMENT

Figure 1:
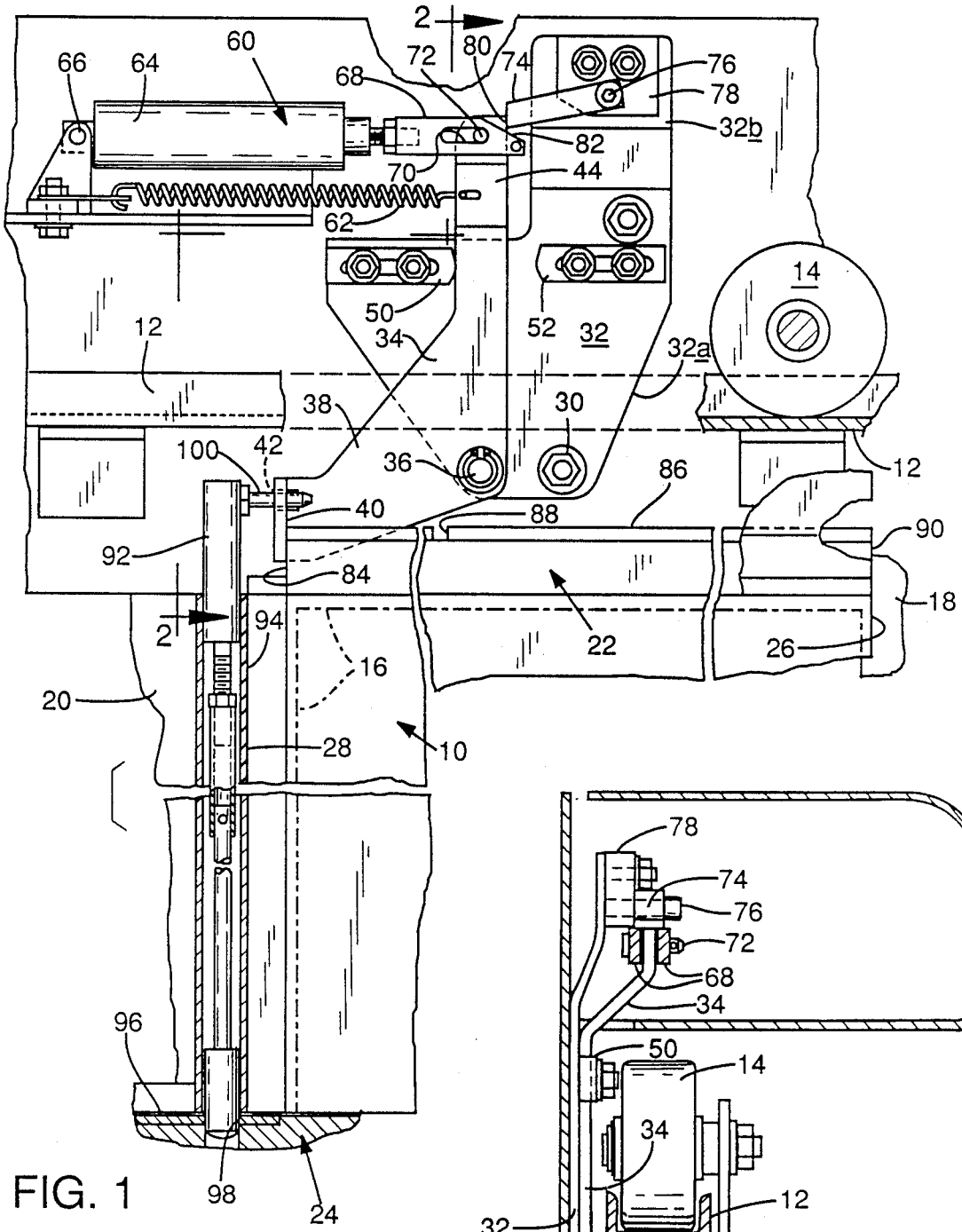
FIG. 1 is a side elevation illustrating the lock mechanism and portions of a door controlled thereby.

Referring now to the drawings, indicated generally at 10 are portions of a door. The door is supported, as on the rail shown at 12 and by suitable rollers such as roller 14 journaled on the door, for movement in a lineal path between a closed position where the door fully closes a door opening shown in dot-dash outline at 16 in FIG. 1, and an open position wherein the door is substantially completely to one side of this door opening. Because opening and closing of the door is by movement in a path which generally extends in the plane of the door, the door is referred to as a sliding door, although the mounting for the door need not strictly be and, in fact, has not been described as, a slide mounting.

The door opening is defined by what is referred to herein as a doorframe, such including vertical expanses 18, 20 and spanning these vertical expanses at their upper extremities, a horizontal expanse 22. The bottom of the door opening is provided by a floor 24, and that portion of this floor which extends under opening 16, in a broad sense, constitutes part of the framing for the door, or the doorframe, as such term is used herein.

Door 10 has what is referred to herein as a lead edge 26 which is the vertical margin or edge of the door which leads the door with the door moved from an open to a closed position, this lead edge lying directly adjacent expanse 18 with the door closed. The opposite vertical edge or margin of the door, shown at 28, is referred to herein as the trailing edge of the door.

Considering now the mechanism provided for locking the door, suitably mounted on the doorframe above door opening 16, as by fasteners including fastener 30, is a mounting plate 32. The particular mounting plate illustrated has a base portion of substantially trapezoidal outline, shown at **32*a*, and a leg portion 32*b* extending upwardly from this base portion from adjacent one side of the base. A frame-mounted locking member, designated at 34, is pivotally mounted on mounting plate 32 by pivot means 36. The pivot means provides a movable mounting for the locking member. The locking member takes the form of a bell crank, having a lower arm 38 extending laterally from pivot means 36 terminating in a right-angle, locking expanse or lock portion 40 which extends normal to the lower arm portion, and is provided with a hole or aperture 42. Also part of the locking member is an upper arm 44 which extends generally upwardly from pivot means 36**.

Any of different means may be provided for limiting the movement afforded the locking member. Thus, and in the particular construction shown, stop abutments 50, 52 are provided mounted on plate 32 to either side of upper arm 44 in the locking member. Downward movement of lower arm 38 in FIG. 1 is limited by abutment 50 engaging arm 44. Movement of the locking member in a clockwise direction from this lowered position is limited by abutment 52, when such engages the right edge of upper arm 44 of the locking member.

The locking member is shifted between these two defined positions by power-operated means which is remotely controllable. In the specific form of the construction such includes a fluid-operated ram, more specifically, an air cylinder 60. The cylinder may be a single-acting air cylinder, extended through the introduction of air under pressure thereto, and contracted when air is permitted to exhaust from the cylinder under the action of an internal spring (not shown). Alternatively, the air cylinder may be double-acting, and extended and retracted by the admission of air under pressure to the appropriate end of the cylinder. Air cylinder 60 has its cylinder end 64 pivotally supported by pivot means 66 on the doorframe. Mounted on and forming an extension of the rod end of the air cylinder is a clevis member 68, terminating in opposed arms that straddle the upper extremity of arm 44 of the locking member. These arms are slotted, as at 70. Securing the clevis member, through a lost-motion type of connection, to the locking member, is a pin 72 passing through such slots and an accommodating bore provided in the upper end of arm 44.

With the construction described, and with the air cylinder actuated to extend, the clevis member moves freely over the end of arm 44 until the left extremities of slots 70, as shown in FIG. 1, reach pin 72. Further extension of the air cylinder causes the locking member to be pivoted about pivot means 36 until movement is stopped by arm 44 striking abutment 52 (refer to FIG. 3). With contraction of the air cylinder, the locking member is pivoted in the opposite direction after take up of the lost motion provided by the slots 70. A coil spring 62 maintains the locking member with arm 44 against abutment 50 when permitted to do so and dependent upon the amount of extension which has occurred in the air cylinder.

Dead latch means is provided which latches the locking member in its locking position, which is the position of the locking member when arm 44 is against abutment 50 and arm 38 is in its lowermost position. Specifically, such comprises a dead latch member 74 pivotally mounted at 76 on a mounting 78 suitably secured to mounting plate 32. The distal end of the dead latch member is formed by a shoulder surface 80 which abuts against and is opposite the right edge of arm 44 with the locking member in its locking position. There is thus provided a mechanical stop preventing movement of the locking member from its locking to its release position. When air cylinder 60 is extended, the beveled forward expanse 82 of the clevis member (referred to herein as a dislodger means), on initial extension of the cylinder, wedges against the lower extent of shoulder surface 80 producing raising of the dead latch member. This continues until the bottom extent of surface 80 becomes positioned on top of the clevis member. This shifting of the dead latch member to its unlatched position occurs without movement of member 34 by reason of the lost motion provided by slots 70. With take up of the lost motion, and on further extension of the cylinder, the locking member is pivoted without restraint offered by the dead latch member which now rides over the top surface of the clevis member.

Door 10 has multiple receptor positions defined therein for the reception of lock portion 40 of the locking member. Specifically, adjacent the trailing edge 28 of the door is an upstanding shoulder portion 84. Extending along the top of the door is a plastomer runner 86, notched at 88. Adjacent the lead edge of the door is an upstanding shoulder portion 90. The door, as shown in FIG. 1, is in its closed position, and in this position portion 40 has dropped downwardly to one side of shoulder portion 84 to prevent movement of the door from right to left, or from its closed position. With raising of arm 38 through actuation of the air cylinder, the door, manually or through power-operated means, may be shifted toward an open position (see FIG. 3). After an initial slight amount of opening movement, the lock portion slides freely on runner 86. With the door opened to the extent that lock portion 40 is over notch 88 (and with the air cylinder not actuated to extend it), arm 38 lowers and the door becomes locked in a partially open position. With actuation of the air cylinder to move the lock portion out of this notch, the door may be fully opened and when fully opened, the lock portion drops over shoulder 90 to lock the door in a fully open position.

The lock mechanism contemplated further may include a door-carried locking member which functions with the door closed to lock the door to the doorframe in another region than the region locked by lock portion 40. With lock 40 portion and shoulder 84 cooperating to lock the door adjacent its top, this other region may be adjacent the base of the door, so that the door is locked both adjacent its top and its bottom.

Further explaining, slidably carried for vertical reciprocal motion adjacent trailing edge 28 of the door, in sleeve structure 94, is a rod assembly 92. The floor is provided with a runner 96, formed with a receptor opening 98, for receiving the bottom of rod assembly 92. The rod assembly adjacent its top is provided with a laterally extending pin 100.

Figures 3, 4:
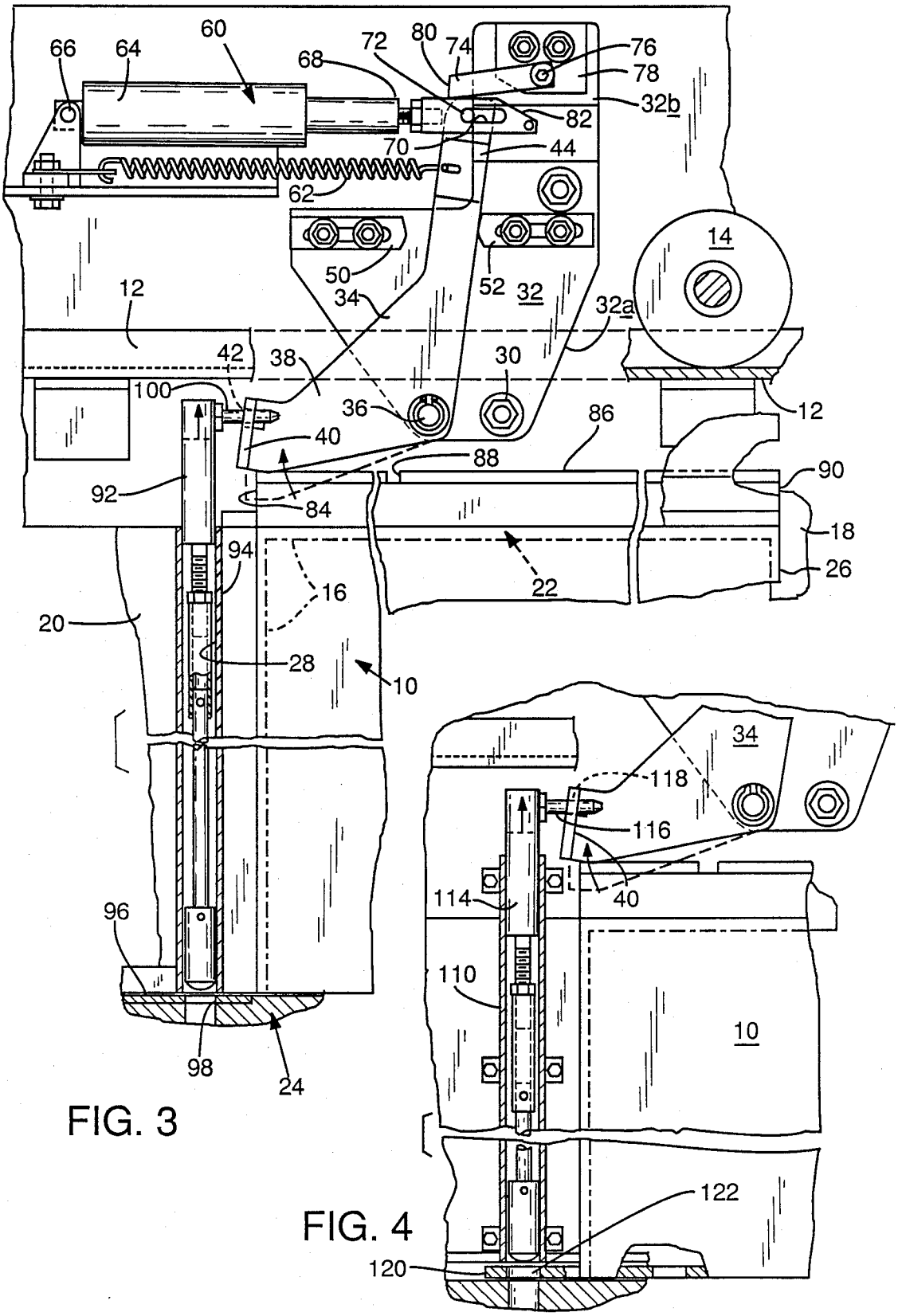
FIG. 3 is a view similar to FIG. 1, but showing the lock mechanism in a different position of adjustment.
FIG. 4 a simplified view showing a modification of the invention.

With the door in a position other than its closed position, the base of the rod assembly rides on runner 96, and pin 100 rides at approximately the elevation shown for the pin in FIG. 3. With the door moved to a position just short of its fully closed position, the base of lock position 40 in arm 38 rides on runner 86, placing aperture 42 at the level of pin 100. Further movement of the door toward its fully closed position advances this aperture whereby the pin is captured by the aperture. Final movement of the door to its closed position frees portion 40 to drop over shoulder portion 84, and with this movement the rod assembly is permitted to drop (under the action of gravity) with the base of the rod assembly moving into receptor 98. Thus, the door becomes locked adjacent its top and bottom, in its fully closed position.

On opening of the door, the locking member is pivoted through actuation of the air cylinder, and with pin 100 captured by aperture 42, this raises rod assembly 92 to free the lower portion of the door together with freeing of the upper portion of the door. Movement of the door from its closed position results in the rod assembly being maintained at this elevation through its bottom end sliding on runner 96. The locking member thus also functions as a shifter member for shifting, after capturing the pin, the door-carried locking member between locking and release positions.

The door may be remotely controlled through electronic controls provided for valving functioning to supply and exhaust air from the air cylinder. The air cylinder may be provided with a substantial throw, permitting it to move clevis member 68 to the extent necessary, first to free the dead latch member and then to produce swinging of the locking member between locking and release positions.

The operation of the lock mechanism should be obvious. With the door closed, the door is locked adjacent its top and bottom by stop 40 in the locking member and by the base of the door-carried rod assembly fitting within receptor 98. To release the door, the air cylinder is actuated, with the clevis member first functioning, and with lost motion occurring between the connection of the clevis member and the locking member, to shift the dead latch member to a position of release. Locking member 34 is then rotated to its release position, which moves locking portion 40 above shoulder 84 and which also functions to raise the rod assembly. With movement of the door away from its closed position, the rod assembly travels with the door in its raised position. The door may be locked in a partially opened position, with movement of portion 40, into notch 88, or in a fully open position, with movement of portion 40 over shoulder portion 90.

Figure 2:
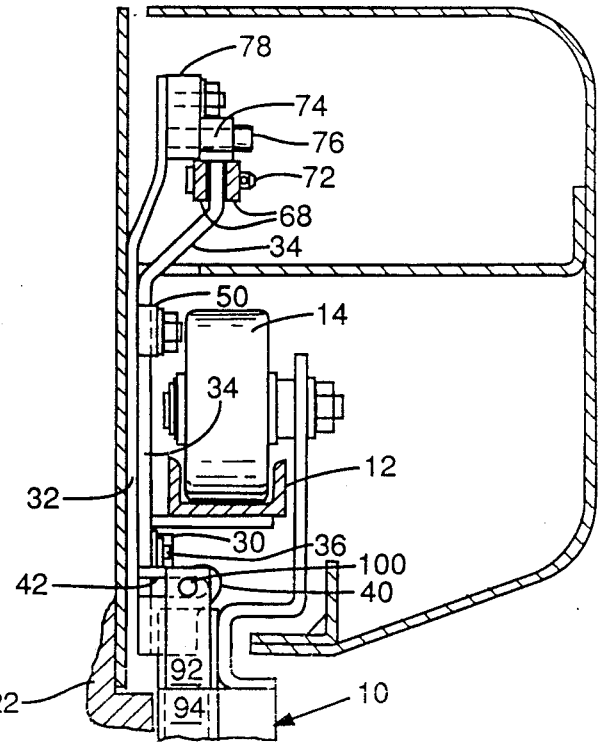
FIG. 2 is a cross-sectional view, taken generally along the line 2—2 in FIG. 1.

A modified form of the invention is shown in FIG. 4. As illustrated in this figure, mounted on the doorframe adjacent the door opening is an upright sleeve 110. Mounted for vertical reciprocal movement in sleeve 110 is a plunger 114, and mounted on the plunger adjacent its top is a laterally extending pin 116. Pin 116 extends into a seat 118 provided in lock portion 40 of locking member 34. The mounting of the locking member and the way that the locking member is actuated may be the same as the construction discussed in FIGS. 1–3.

Door 10 adjacent its base and its trailing edge is provided with a tab 120 projecting laterally of the door and containing a receptor opening 122. With the door closed, opening 122 is positioned below the base of plunger 114. With locking member 34 in its locking position (its lowered position), plunger 114 under the action of gravity drops downwardly to a position where its bottom end seats in opening 122. This locks the door adjacent its base. The plunger thus constitutes another locking member, or locking device, which is movably mounted on the doorframe. When member 34 is pivoted to its release position, plunger 114 is raised by member 34 to free its bottom end from opening 122 and to unlock the base of the door. The door may then be moved to an open position, the door clearing sleeve 110 by reason of its sleeve being mounted behind the path of the door as illustrated in FIG. 4.

While an embodiment of the invention has been described, obviously modifications and variations are possible without departing from the invention.

It is claimed and desired to secure by Letters Patent:

1. In combination with a doorframe defining a door opening and a movable door mounted for movement between positions opening and closing said door opening, lock mechanism comprising:

a frame-carried locking member movably mounted on the doorframe for movement between a locking position and a release position where the door is located and released, respectively, power-operated means operatively connected to and for moving the locking member between said locking and release positions, a movable dead latch member mounted on the doorframe movable between a latching position latching the locking member in its locking position and an unlatching position where the locking member is free to move to its release position, means for moving the dead latch member to its unlatching position, a door-carried locking member shiftable between locking and release positions where the door is locked and released, respectively, said door-carried locking member being mounted on the door to be carried by the door, said doorframe including a receptor for receiving the door-carried locking member with the door closed and the door-carried locking member in its locking position, said frame-carried locking member including means engageable with the door-carried locking member with the door closed producing shifting of the door-carried locking member to a release position with movement of the frame-carried locking member to a release position.

2. The combination of claim 1, which further includes another frame-carried locking member movably mounted on the doorframe for movement between a locking and a release position where the door is locked and released, respectively, and wherein said power-operated means is operatively connected to said other locking member for moving the other locking member between locking and release positions.

3. In combination with a doorframe defining a door opening and a movable door mounted for movement between positions opening and closing said door opening, lock mechanism comprising:

a crank member pivotally mounted on the doorframe pivotable between a locking position where an end of the member engages to the door to lock it and a release position where the door is released, a power-operated fluid ram operatively connected to said crank member operable on actuation of the ram to pivot the crank member between said locking and release positions, a movable dead latch member mounted on the doorframe movable between a latching position where the crank member is latched in its locking position and an unlatching position where the crank member is free to pivot, and means actuated by said ram producing movement of said dead latch member to its unlatching position with such movement preceding movement of the crank member from said locking to said unlocking position.

4. The combination of claim 3, wherein said door has means defining multiple receptor positions thereon, each adapted to receive the end of the crank member, said crank member when received in any one of said receptor positions locking the door.

5. The combination of claim 3, which further includes a locking device movably mounted on the doorframe for movement between a locking and a release position where the door is locked and released, respectively, and wherein said crank member is operatively connected to said locking device so as to produce movement of the locking device between its locking and release positions with movement of the crank member between locking and release positions.

6. The combination of claim 3, which further comprises a door-carried locking member carried by the door and shiftable between locking and unlocking positions locking and unlocking the door, and wherein said crank member has means for engaging said door-carried locking member, the crank member when engaging said door-carried locking member and on pivoting from a locking to an unlocking positions being operable to shift said door-carried locking member to an unlocking position.

7. In combination with a doorframe defining a door opening and a door movably mounted on the doorframe for movement between positions opening and closing said door opening;

a door-carried locking member mounted on the door to be carried by the door and shiftable between locking and unlocking positions locking and unlocking the door, receptor means defined in said doorframe for receiving the door-carried locking member with the door closed and the locking member occupying its locking position, shifter means mounted on the doorframe engageable with the door-carried locking member with the door closed and actuatable when engaging the door-carried locking member to shift the door-carried locking member to an unlocking position, said shifter means releasing from the locking member with movement of the door toward a position opening said door opening.

8. The combination of claim 7, wherein said shifter means comprises a crank member pivotally mounted on the doorframe, said crank member being pivotable between first and second positions, said crank member having a locking portion which engages the door to lock it in position with the crank member in its said first position and said locking portion releasing the door with the crank member in its second position, said crank member being engageable with said door-carried locking member with the crank member in said first position.

* * * * *